US008845817B2

(12) United States Patent
Bakehorn et al.

(10) Patent No.: US 8,845,817 B2
(45) Date of Patent: Sep. 30, 2014

(54) NON-TOXIC CLEANING AGENT

(71) Applicant: Green Way Laboratories, Long Beach, CA (US)

(72) Inventors: Thomas Bakehorn, Dana Point, CA (US); Guy Roland Adams, Laguna Niguel, CA (US)

(73) Assignee: Green Way Laboratories, Long Beach, CA (US)

( * ) Notice: Subject to any disclaimer, the term of this patent is extended or adjusted under 35 U.S.C. 154(b) by 0 days.

(21) Appl. No.: 13/910,674

(22) Filed: Jun. 5, 2013

(65) Prior Publication Data

US 2013/0326830 A1 Dec. 12, 2013

Related U.S. Application Data

(60) Provisional application No. 61/657,009, filed on Jun. 7, 2012.

(51) Int. Cl.

| | |
|---|---|
| ***C11D 1/12*** | (2006.01) |
| ***C11D 1/22*** | (2006.01) |
| ***C11D 1/66*** | (2006.01) |
| ***C11D 1/83*** | (2006.01) |
| ***C11D 3/18*** | (2006.01) |
| ***C11D 3/43*** | (2006.01) |
| ***B08B 3/04*** | (2006.01) |
| ***C11D 17/04*** | (2006.01) |
| ***B08B 1/00*** | (2006.01) |
| ***C11D 3/382*** | (2006.01) |
| ***C11D 1/831*** | (2006.01) |

(52) U.S. Cl.

CPC *C11D 1/831* (2013.01); *C11D 1/83* (2013.01); *C11D 17/049* (2013.01); *C11D 3/43* (2013.01); *B08B 1/006* (2013.01); *C11D 3/382* (2013.01); *C11D 1/22* (2013.01)

USPC ..... 134/25.2; 134/25.3; 134/39; 134/42; 510/200; 510/245; 510/251; 510/421; 510/426; 510/432; 510/437; 510/495; 510/505

(58) Field of Classification Search

CPC ..... B08B 3/04; C11D 1/12; C11D 1/22; C11D 1/66; C11D 3/18; C11D 3/2044; C11D 3/2093; C11D 3/43

USPC ..... 510/200, 245, 251, 421, 426, 432, 437, 510/495, 505; 134/25.2, 25.3, 39, 42

See application file for complete search history.

(56) References Cited

U.S. PATENT DOCUMENTS 7,618,931 B1 * 11/2009 Scheuing et al. ..... 510/340

FOREIGN PATENT DOCUMENTS

WO WO 2010/139107 * 12/2010 ..... C11D 1/83

* cited by examiner

*Primary Examiner* — Brian P Mruk

(74) *Attorney, Agent, or Firm* — Sughrue Mion, PLLC

(57) ABSTRACT

Provided herein is an aqueous, non-toxic, non-flammable, non-explosive, biodegradable, hypoallergenic cleaning composition. Also provided are pre-loaded wipes containing the cleaning solution, kits, and methods of cleaning surfaces using the same.

23 Claims, No Drawings

NON-TOXIC CLEANING AGENT

CROSS REFERENCE TO RELATED APPLICATION(S)

This application claims the benefit of priority under 35 U.S.C. §119(e) of U.S. Ser. No. 61/657,009, filed Jun. 7, 2012, the entire content of which is incorporated herein by reference.

BACKGROUND OF THE INVENTION

1. Field of the Invention

The invention relates generally to cleaning agents and more specifically to a non-toxic, hypo-allergenic, non-fuming, biodegradable, and non-volatile cleaning composition that operates to remove stubborn tar-based materials like mastic, grease, oils, adhesives, and much more from hands, tools, or any washable indoor or outdoor surface.

2. Background Information

Cleaning agents generally include substances for removing dirt, oil, odor, and other unwanted material from surfaces. Typically, cleaning agents are solvent-based or may otherwise include acidic, alkaline, or neutral compositions depending on the intended purpose. Cleaning agents are generally separated into consumer grade or industrial grade agents, with the latter generally considered more effective and dangerous than the former.

Adhesives are compositions generally meant to bond two objects together. Adhesives typically include solvents which evaporate after application, creating a bond between the objects. As such, adhesives are often liquids or semi-liquids, and the compositions are manufactured to complement the materials and environmental effects that the materials and adhesives will likely endure. For example, mastic is a very sticky adhesive typically used for bonding shingles to the roof of a home.

Many adhesives, such as mastic, are manufactured to maximize longevity and withstand extreme outdoor environmental effects. As such, mastic is very sticky and tacky, and while it is very effective in roofing, it is extremely difficult to remove from the hands, clothing, and other surfaces.

Several cleaning compositions exist, with many designed specifically to remove difficult adhesives such as mastic. However, these compositions are often toxic, abrasive, flammable, explosive, and hazardous. Therefore, a need exists for a cleaning agent that is capable of tackling difficult adhesives while still being safe, non-toxic, and otherwise safe for consumer use.

SUMMARY OF THE INVENTION

The present invention provides a colloid active cleaning composition that operates to remove organic and non-organic tars, greases, oils, adhesives, and much more from hands, tools, or any non-porous washable indoor or outdoor surface. The cleaning composition is pH neutral, non-toxic, non-flammable, bio-degradable, non-volatile solvent-based, and hypo-allergenic. It is a safe alternative to acidic, caustic, and solvent-based cleaners currently used in many industries such as construction, automotive, agriculture, aerospace, marine, hospitality, hospitals, military, government/state institutions, municipalities, public schools, and Universities. Furthermore, the present invention can extend beyond institutional/industrial use, and into consumer use, as it is a safe alternative for cleaning organic and non-organic compounds in an environmentally friendly and non-hazardous manner.

The present invention thus provides a homogeneous blend of non-reactive, non-toxic, organic chemicals in a colloidal suspension in water that emulsifies, wets, and suspends the products to be removed quickly and completely, thus allowing difficult substances to be removed from skin, hands, face, tools, and all non-porous surfaces quickly, effectively, and without the need to use water or additional materials in the process of cleaning. The cleaning composition can be applied directly in liquid form, or can be preloaded onto a wipe or cloth for easy dispensing and use.

Accordingly, in one aspect, the invention provides a cleaning composition. The composition includes 0.05% to 3.0% (w/v) of a non-ionic surfactant, which may have a pH value between 6.5 and 7.5; 0.03% to 0.05% (w/v) of an ionic surfactant, which may have a pH value between 7.5 and 10.5; 0.05% to 1.5% (w/v) of a first solvent; 0.05% to 1.0% (w/v) of a second solvent, which may have a pH value between 7.6 and 8.8; 2.0% to 4.0% (w/v) of an oil; 0.05% to 1.0% of a moisturizing agent, which may have a pH value between 6.0 and 8.5; and 89.45% to 97.77% (w/v) of water. In various embodiments, the non-ionic surfactant is 1.5% (w/v), and may be derived from soybean oil, such as ECOSURF™ SA-9. In various embodiments, the ionic surfactant is 0.05% (w/v), and may be a sodium salt of alkyl naphthalene sulfonic acid, such as NAXAN® PLUS 220. In various embodiments, first solvent is 0.05% (w/v), and may be a dibasic ester solvent, such as RHODIASOLV® Iris. In various embodiments, the second solvent is 1.0% (w/v), and may be a propanediol solvent such as ZEMEA® propanediol. In various embodiments, the oil is 2.2% (w/v), and may be selected from the group consisting of coconut, palm, castor, rapeseed, and soybean oils. In various embodiments, the water is deionized water, and may be 95.15% (w/v) of the composition. In various embodiments, the moisturizer is HYDROVANCE®.

In another aspect, the invention provides a cleaning wipe. The cleaning wipe includes a substrate and a cleaning composition, wherein the composition includes 0.05% to 3.0% (w/v) of a non-ionic surfactant, which may have a pH value between 6.5 and 7.5; 0.03% to 0.05% (w/v) of an ionic surfactant, which may have a pH value between 7.5 and 10.5; 0.05% to 1.5% (w/v) of a dibasic ester solvent; 0.05% to 1.0% (w/v) of a propanediol solvent, which may have a pH value between 7.6 and 8.8; 2.0% to 4.0% (w/v) of an oil; 0.05% to 1.0% of a moisturizing agent, which may have a pH value between 6.0 and 8.5; and 89.45% to 97.77% (w/v) of water. In various embodiments, the substrate includes at least one material selected from the group consisting of melt-blown, coform, air-laid, spun bond, wet-laid, bonded-carded web materials, hydroentagled and spulaced materials. In various embodiments, the substrate is a melt-blown, dual-textured, non-woven wipe.

In another aspect, the invention provides a non-toxic cleaning kit. The kit includes at least one cleaning substrate preloaded with a non-toxic cleaning solution, and a packaging system dispensibly housing the at least one cleaning substrate. The cleaning solution includes 0.05% to 3.0% (w/v) of a non-ionic surfactant, which may have a pH value between 6.5 and 7.5; 0.03% to 0.05% (w/v) of an ionic surfactant, which may have a pH value between 7.5 and 10.5; 0.05% to 1.5% (w/v) of a dibasic ester solvent; 0.05% to 1.0% (w/v) of a propanediol solvent, which may have a pH value between 7.6 and 8.8; 2.0% to 4.0% (w/v) of an oil; 0.05% to 1.0% of a moisturizing agent, which may have a pH value between 6.0 and 8.5; and 89.45% to 97.77% (w/v) of water. In various embodiments, the substrate includes at least one material selected from the group consisting of melt-blown, coform, air-laid, spun bond, wet-laid, bonded-carded web materials, hydroentagled and spulaced materials. In various embodiments, the substrate is a melt-blown, dual-textured, non-woven wipe. In various embodiments, the kit also includes an implement configured for detachable mounting of the substrate. In various embodiments, the kit also includes directions for use.

In another aspect, the invention provides a method for cleaning a hard surface. The method includes contacting the surface with the cleaning composition provided herein.

DETAILED DESCRIPTION OF THE INVENTION

The present invention is based on the finding that a non-toxic, hypo-allergenic, non-fuming, and biodegradable cleaning composition is effective at removing tar-based materials such as mastic, grease, oils, and adhesives from hands, tools, or any washable indoor or outdoor surface.

Before the present compositions and methods are described, it is to be understood that this invention is not limited to particular compositions, methods, and experimental conditions described, as such compositions, methods, and conditions may vary. It is also to be understood that the terminology used herein is for purposes of describing particular embodiments only, and is not intended to be limiting, since the scope of the present invention will be limited only in the appended claims.

As used in this specification and the appended claims, the singular forms "a", "an", and "the" include plural references unless the context clearly dictates otherwise. Thus, for example, references to "the method" includes one or more methods, and/or steps of the type described herein which will become apparent to those persons skilled in the art upon reading this disclosure and so forth.

The term "comprising," which is used interchangeably with "including," "containing," or "characterized by," is inclusive or open-ended language and does not exclude additional, unrecited elements or method steps. The phrase "consisting of" excludes any element, step, or ingredient not specified in the claim. The phrase "consisting essentially of" limits the scope of a claim to the specified materials or steps and those that do not materially affect the basic and novel characteristics of the claimed invention. The present disclosure contemplates embodiments of the invention compositions and methods corresponding to the scope of each of these phrases. Thus, a composition or method comprising recited elements or steps contemplates particular embodiments in which the composition or method consists essentially of or consists of those elements or steps.

Unless defined otherwise, all technical and scientific terms used herein have the same meaning as commonly understood by one of ordinary skill in the art to which this invention belongs. Although any methods and materials similar or equivalent to those described herein can be used in the practice or testing of the invention, the preferred methods and materials are now described.

As used herein, the term "substrate" is intended to include any material that is used to clean an article or a surface. Examples of cleaning substrates include, but are not limited to nonwovens, sponges, films and similar materials, which can be attached to a cleaning implement, such as a toilet cleaning device. As used herein, "disposable" is used in its ordinary sense to mean an article that is disposed or discarded after a limited number of usage events, preferably less than 25, more preferably less than about 10, and most preferably less than about 2 entire usage events.

As used herein, "wiping" refers to any shearing action that the substrate undergoes while in contact with a target surface. This includes hand or body motion, substrate-implement motion over a surface, or any perturbation of the substrate via energy sources such as ultrasound, mechanical vibration, electromagnetism, and so forth.

As used herein, the terms "nonwoven" or "nonwoven web" means a web having a structure of individual fibers or threads which are interlaid, but not in an identifiable manner as in a knitted web. Nonwoven webs have been formed from many processes, such as, for example, meltblowing processes, spunbonding processes, and bonded carded web processes.

As used herein, the term "polymer" generally includes, but is not limited to, homopolymers, copolymers, such as for example, block, graft, random and alternating copolymers, terpolymers, etc., and blends and modifications thereof. Furthermore, unless otherwise specifically limited, the term "polymer" shall include all possible geometrical configurations of the molecule. These configurations include, but are not limited to isotactic, syndiotactic and random symmetries.

The term "sponge," as used herein, is meant to mean an elastic, porous material, including, but not limited to, compressed sponges, cellulosic sponges, reconstituted cellulosic sponges, cellulosic materials, foams from high internal phase emulsions, such as those disclosed in U.S. Pat. No. 6,525,106 (incorporated herein by reference), polyethylene, poly-propylene, polyvinyl alcohol, polyurethane, polyether, and polyester sponges, foams and nonwoven materials, and mixtures thereof.

The present invention is directed to an aqueous, non-toxic, non-flammable, non-explosive, biodegradable, hypoallergenic, and otherwise innocuous cleaning composition. The composition includes a non-ionic surfactant, an ionic surfactant, a dibasic ester solvent, a propanediol solvent, and an oil. In various embodiments, the composition may further include a moisturizing agent. It should be understood that these components will be referred to as "organic chemicals" throughout the present disclosure.

Accordingly, using the methodology described below, the indicated percent amounts of the blended constituents together form the aqueous, non-toxic, non-flammable, non-explosive, biodegradable, hypoallergenic cleaning composition. It should be understood that relative proportions of the constituents can be adjusted to optimize results based upon the stipulated design factors and desired characteristics and qualities of the end-user.

Surfactants

The term "surfactant", as used herein, refers to a substance or compound that reduces surface tension when dissolved in water or water solutions, or that reduces interfacial tension between two liquids, or between a liquid and a solid. The term "surfactant" thus includes anionic, non-ionic, amphoteric, zwitterionic surfactants and mixtures thereof. Surfactants may act as detergents, wetting agents, emulsifiers, foaming agents, and dispersants.

The non-ionic surfactant may be of oleochemical origin to provide superior wetting, excellent detergency, rapid dissolution, and biodegradability. As such, the non-ionic surfactant may be derived from plant oils, such as, but not limited to, coconut, palm, castor, rapeseed, and soybean oils. In various embodiments, the non-ionic surfactant is derived from a seed oil, such as soybean oil. The non-ionic surfactant will have a pH value between about 6.5 and 7.5, between about 6.8 and 7.2, or between about 6.9 and 7.1. In certain embodiments, the non-ionic surfactant will have a pH of 7.1. In addition, the non-ionic surfactant will range between about 0.05% and 3.0% (weight/volume), between about 0.10% and 2.0% (w/v), or between about 0.25% and 1.5% (w/v) of the cleaning composition. In certain embodiments, the cleaning composition will include 1.5% (w/v) of the non-ionic surfactant. Exemplary oleochemical surfactants suitable for use as the non-ionic surfactant include, but are not limited to, the ECO-SURF™ line manufactured by The Dow Chemical Company. In certain embodiments, the non-ionic surfactant is ECO-SURF™ SA-9 (The Dow Chemical Company).

The ionic surfactant may be a sodium salt of alkyl naphthalene sulfonic acid to provide low foam, acid and base stability, hard water tolerance, fast wetting, good hydrotroping properties, and biodegradability. As such, the ionic surfactant may be an alkylated naphthalene sulfonate. The ionic surfactant will have a pH value between about 7.5 and 10.5, between about 8.5 and 9.5, or between about 8.7 and 9.2 In addition, the ionic surfactant will range between about 0.03% and 0.05% (w/v) of the composition. In certain embodiments, the cleaning composition will include 0.05% (w/v) of the ionic surfactant. Exemplary surfactants suitable for use as the ionic surfactant include, but are not limited to, the NAXAN® PLUS line manufactured by Nease Corporation. In certain embodiments, the ionic surfactant is NAXAN® PLUS 220 (Nease Corporation).

Solvents

The cleaning composition may include one or more solvents suitable for industrial grade cleaning. In certain embodiments, the cleaning solution may include a first solvent and a second solvent. The first solvent may be a dibasic ester solvent that is derived from an ester of a dicarboxylic acid, and provides a powerful, non-toxic, non-flammable, efficient solvent that is suitable for industrial grade cleaning. Mixtures of different methyl dibasic esters are commercially produced from short-chain acids such as adipic acid, glutaric acid, and succinic acid. In various embodiments, the dibasic ester solvent will be aliphatic and may be in liquid form. The aliphatic dibasic ester solvent may have a pH value between about between 6.0 and 8.0, between about 6.5 and 7.5, or between about 6.8 and 7.2. In addition, the dibasic ester solvent will range between about 0.05% and 1.5% (w/v), between about 0.10% and 1.0% (w/v), or between about 0.25% and 0.75% (w/v) of the composition. In certain embodiments, the cleaning composition will include 0.05% (w/v) of the dibasic ester solvent. Exemplary dibasic ester solvents suitable for use in the cleaning composition include, but are not limited to, dibasic ester-based solvents produced by diacid esterification with any of a number of alcohols, manufactured by Rhodia. In certain embodiments, the dibasic ester solvent is RHODIASOLV® Iris (Rhodia).

The second solvent may be a propanediol solvent that is made from all natural sources such as corn syrup, that will not irritate the skin. The propanediol solvent may be a polar liquid such as 1,3-propanediol. The 1,3-propanediol may have a pH value between about 6.5 and 9.0, about 7.0 and 9.0, or about 7.6 and 8.8 In addition, the 1,3-propanediol solvent will range between about 0.05% and 2.0% (w/v), between about 0.10% and 1.5% (w/v), or between about 0.25% and 1.0% (w/v) of the composition. In certain embodiments, the cleaning composition will include 1.0% (w/v) of the 1,3-propanediol solvent. Exemplary 1,3-propanediol solvents useful in the cleaning composition include, but are not limited to, trimethylene glycol and ZEMEA® propanediol, manufactured by DuPont Tate & Lyle BioProducts, LLC.

Oil

The oil may be any of oleochemical origin to provide natural moisturizing properties and high lubrication. As such, the oil may be derived from plant oils, such as, but not limited to, coconut, palm, castor, rapeseed, and soybean oils. In various embodiments, the oil is a seed oil, such as soybean oil, and may be in liquid form. In addition, the oil will range between about 1.5% and 4.5% (w/v), between about 1.7% and 4.2% (w/v), or between about 2.0% and 4.0% (w/v) of the composition. In certain embodiments, the cleaning composition will include 2.2% (w/v) of the oil. Exemplary oils useful in the cleaning composition include, but are not limited to, industrial grade soybean oils such as Technical Grade RBD Soybean Oil, manufactured by Cargill.

Moisturizing Agent

The moisturizing agent may include any agent that promotes a non-tacky, non-greasy aesthetic to the cleaning composition. As such, the moisturizing agent may be Hydroxyethyl Urea, which is provided in an aqueous solution. The moisturizing agent will have a pH value of between about 6.0 and 8.5, between about 6.5 and 8.0, or between about 7.0 and 7.5. In addition, the moisturizing agent will range between about 0.025% and 1.0% (w/v), about 0.04% and 0.75% (w/v), or about 0.05% and 0.50% (w/v) of the composition. In certain embodiments, the cleaning composition will include 0.05% (w/v) of the moisturizing agent. An exemplary moisturizing agent for use in the cleaning composition includes, but is not limited to HYDROVANCE® (AzkoNobel).

Water

It should be noted that the main ingredient in the cleaning composition is water. Water provides the continuous liquid phase into which the other ingredients are added to be dissolved/dispersed. The weight ratio of the water to the mixed composition ranges from approximately 14:1 to 28:1, wherein the cleaning composition will include about 3.65% to 6.75% organic chemicals and about 93.25% to 96.35% water. In various embodiments, the cleaning composition will include about 95.15% water. In various embodiments, the cleaning composition will include about 2.30% to 10.55% organic chemicals and about 89.45% to 97.77% water. In various embodiments, the cleaning composition will include about 4.0% organic chemicals and about 96.0% water. The water used in the composition is typically deionized water and/or industrial soft water so as to reduce residue formation and limit the amount of undesirable metal ions in the improved cleaning composition; however, other types of water can be used (e.g., tap water, spring water, filtered water, etc.). In various embodiments, the water is deionized water.

Miscellaneous Adjuncts

Small amounts of adjuncts can be added for improving aesthetic qualities of the cleaning solution. Aesthetic adjuncts include fragrances or perfumes, such as those available from Givaudan-Rohre, International Flavors and Fragrances, Quest, Sozio, Firmenich, Dragoco, Norda, Bush Boake and Allen and others, and dyes or colorants which can be solubilized or suspended in the cleaning composition. The adjuncts include, but are not limited to, skin exfoliant agents and/or abrasives, waxes, dyes and/or colorants, solubilizing materials, stabilizers, thickeners, defoamers, hydrotropes, lotions and/or mineral oils, enzymes, and/or preservatives. In addition, buffering and/or pH adjusting agents may be included in the cleaning composition, as necessary.

Exemplary materials useful as exfoliating agents in the cleaning solution include, but are not limited to, synthetic polymeric particles. Synthetic polymeric particles useful in the present invention are selected from the group consisting of polybutylene, polyethylene, polyisobutylene, polymethylstyrene, polypropylene, polystyrene, polyurethane, oxidized derivatives thereof, nylon, teflon, and mixtures thereof. Non-limiting examples of suitable exfoliating agents include oxidized polyethylene beads commercially available as A-C Oxidized Polyethylene beads from Honeywell and ACCUSCRUB™ beads from Accutech, LLC.

Use of the Cleaning Composition

As discussed above, present invention provides an aqueous, non-toxic, non-flammable, non-explosive, biodegradable, hypoallergenic cleaning composition. Use of the cleaning composition is accomplished by contacting the solution with a surface to be cleaned. In certain embodiments, a method of cleaning includes receiving an article that has been soiled by one or more of an asphalt-based material, chemical tar, oil, or chemical, and contacting the cleaning composition therewith for a time sufficient to allow for cleaning. In various embodiments, contact of the cleaning composition with the article to be cleaned is performed by spraying or pouring the composition directly thereon, submerging the article in a vessel containing the cleaning solution, or by using a substrate on which the cleaning solution has been pre-loaded. The thickness of the applied coating of cleaning solution may range from between about 0.1 to 0.5 grams per square, although any thickness may be applied. Alternatively, a range of between about 0.1 oz and 0.4 oz of the cleaning composition may be used when applied with a substrate, although any amount of the cleaning solution may be used in accordance with the absorption or adsorption of the substrate used therewith.

Additionally, the cleaning solution may be used as a deodorizing agent, as the cleaning solution dissolves odor-causing organic substances. Use of the cleaning composition for deodorizing is accomplished by contacting the solution with a surface to be deodorized. In certain embodiments, a method of deodorizing includes spraying the cleaning solution onto an article that has been soiled by organic waste, such as mammalian urine and/or fecal materials.

Preparation of the Cleaning Composition

The cleaning composition of the present invention is generally prepared by conventional methods such as are known in the art. Such methods typically involve mixing of the ingredients in one or more steps to a relatively uniform state, with or without heating, cooling, application of vacuum, and the like. In various embodiments, the cleaning composition is prepared by the following steps:

To a mixing tank, add 0.05% to 3.0% (w/v) of the non-ionic surfactant;

Add 0.03% to 0.05% (w/v) of the ionic surfactant;

Add 0.05% to 1.5% (w/v) of the dibasic ester solvent;

Add 0.05% to 1.0% (w/v) of the propanediol solvent;

Add 2.0% to 4.0% (w/v) of the industrial grade soybean oil;

Add 0.05% to 1.0% (w/v) of the moisturizing agent; and 89.45% to 97.77% (w/v) of deionized water.

Transfer the blended cleaning composition to a holding tank and store until ready for use. In various embodiments, the blended composition may be dispensed into individual containers, as described below, into which one or more substrates may be inserted and stored for use.

Substrates

The cleaning composition may be part of, or used in conjunction with, a cleaning substrate. A wide variety of materials can be used as the cleaning substrate. The substrate may have sufficient wet strength, abrasivity, loft and porosity such that it may be used to clean an article or part of the body. Examples of suitable substrates include, nonwoven substrates, woven substrates, hydroentangled substrates, foams and sponges. Any of these substrates may be water-insoluble, water-dispersible, or water-soluble. Generally, the cleaning substrate is in sheet form, that is, in a form in which the cross-sectional thickness dimension of the substrate is proportionally smaller than either its approximate width or length dimension in order to provide at least one surface whose surface area is sized appropriately with respect to the intended surface to be treated with the cleaning solution. The cleaning substrate may be formed into individual sheets or wipes, or may be a continuous sheet, preferably with some separation means provided, such as partial tears or perforations across at least one dimension of the sheet, such that the sheet may be subdivided prior to use to a suitable size for the particular need at hand.

When the substrate is a wipe, it is generally made from an absorbent or adsorbent material. In various embodiments, the wipe is at least one layer, made of wood pulp; or a blend of wood pulp and a synthetic fiber such as, without limitation, polyester, rayon, nylon, polypropylene, polyethylene, other cellulose polymers; or a synthetic fiber; or a mixture of any such fibers. Thus, nonwoven fibrous sheet materials include, but are not limited to, melt-blown, coform, air-laid, spunbond, wet laid, bonded-carded web materials, hydroentangled (also known as spunlaced) materials, and combinations thereof. A binder may or may not be present. Examples of such substrates are depicted in U.S. Pat. No. 4,781,974, U.S. Pat. No. 4,615,937, U.S. Pat. No. 4,666,621, WO 98/03713, U.S. Pat. No. 5,908,707, WO 97/40814, WO 96/14835 and EP 750063, the entire content of each of which are incorporated herein by reference. In various embodiments, the wipe will include multiple layers of the same or different wipes that are bonded together to form a unitary wipe. The bonding may be arranged such that geometric shapes and patterns, e.g., diamonds, circles, squares, etc., are created on the exterior surfaces of the layers and the resulting article. In certain embodiments, the cleaning wipe is a melt-blown, dual-textured, non-woven wipe. Non-limiting examples of commercially available cleaning wipes that can be used in conjunction with the cleaning solution include DuPont 8838, Dexter ZA, Dexter 10180, Dexter M10201, Dexter 8589, Ft. James 836, and Concert STD60LN.

As discussed above, the cleaning composition may be sprayed and/or poured onto a hard surface to be cleaned, and an absorbent and/or adsorbent substrate such as, but not limited to, cleaning wipe, sponge (e.g., cellulose, synthetic, etc.), cleaning pad, paper towel, napkin, cloth, towel, rag, mop head, brush, squeegee, and/or other cleaning device used to spread the composition on the hard surface and/or clean the hard surface. Additionally or alternatively, the improved cleaning composition may be at least partially loaded on the absorbent and/or adsorbent substrate prior to cleaning the hard surface. Thus, the present invention also contemplates the pre-loading of the composition on a cleaning pad and/or cleaning wipe. The pre-loaded composition on the cleaning pad or cleaning wipe is typically in a ready to use liquid form; however, the composition can be in a concentrate-in-liquid, semi-liquid or solid form on the cleaning pad or cleaning wipe. The cleaning pad can also include one or more layers of nonwoven material. The first layer and the second layer, as well as additional layers, when present, may be bonded to one another in order to maintain the integrity of the substrate. The layers may be heat spot bonded together or may be bonded using heat generated by ultrasonic sound waves.

The cleaning pad typically has an absorbent capacity, depending on its size and composition. Thus, the absorbency and/or fluid capacity of the cleaning pad can vary depending on the desired use of the cleaning pad. The cleaning wipe can have the same or different amount of absorbency. The cleaning wipe or pad may also contain a superabsorbent material to enhance the absorbency and/or fluid capacity of the cleaning pad or cleaning wipe. When a superabsorbent material is included in the cleaning pad or cleaning wipe, the cleaning pad or cleaning wipe will typically comprise at least about 1% by weight of the cleaning pad or cleaning wipe, and more typically at least about 5%.

The cleaning pad or cleaning wipe can also include materials to stiffen the cleaning pad or cleaning wipe. Such materials include, but are not limited to, chemically stiffened cellulosic fibers. The cleaning pad or cleaning wipe can also include a thermoplastic material to at least partially bind together the adsorbent and/or adsorbent fibers in the cleaning pad or cleaning wipe. The thermoplastic material can also enhance the integrity of the cleaning pad or cleaning wipe.

The cleaning composition may be loaded onto the cleaning wipe and/or cleaning pad in any number of manufacturing methods. Typically, the cleaning wipe or cleaning pad is soaked in the cleaning composition for a period of time until the desired amount of loading is achieved. The cleaning pad or cleaning wipe can also have an attachment layer that allows the cleaning pad or cleaning wipe to be connected to and/or disconnected from an implement's handle or the support head or an implement (e.g., mop, broom, etc.). The attachment layer can also function to prevent fluid flow through the top surface (e.g., the handle-contacting surface) of the cleaning pad or cleaning wipe, and/or can further provide enhanced integrity for the cleaning pad or cleaning wipe.

The cleaning wipes can be maintained over time in a sealable container such as, for example, within a bucket with an attachable lid, sealable plastic pouches or bags, canisters, jars, tubs and so forth. In certain embodiments, one or more cleaning substrates may be packaged in tear open packets. In various embodiments, the wet, stacked cleaning substrates are maintained in a resealable container. The use of a resealable container in conjunction with the cleaning composition may reduce evaporation of substantial amounts of water while using the first substrates, thereby preventing the remaining substrates from drying out. Exemplary resealable containers and dispensers include, but are not limited to, those described in U.S. Pat. No. 4,171,047, U.S. Pat. No. 4,353,480, U.S. Pat. No. 4,778,048, U.S. Pat. No. 4,741,944, U.S. Pat. No. 5,595,786, and U.S. Pub. No. 2011/0005943; the entire contents of each of which are incorporated herein by reference. The cleaning substrates can be incorporated or oriented in the container as desired and/or folded as desired in order to improve ease of use and/or removal, as is known in the art.

The cleaning solution and cleaning pad or cleaning wipe can also be part of a cleaning kit. The kit can have an assembly of one or more units, either packaged together or separately. The kit includes a container containing one or more cleaning pads and/or cleaning wipes, and the composition. As discussed above, the cleaning pads or wipes may be pre-loaded with the cleaning solution. The kit may further include an implement upon which the cleaning pad or cleaning wipe can be detachably mounted so that the cleaning pad or cleaning wipe can be removed and/or replaced with a fresh clean pad or cleaning wipe. The implement can also include a dosing device that delivers the cleaning composition onto the cleaning pad or cleaning wipe and/or onto the surface to be cleaned. The dosing device can be battery powered, electrically powered, or hand powered. The implement can also have a reservoir that contains the cleaning composition. The reservoir can be refillable or contain a non-refillable amount of the cleaning composition. The reservoir can also be detachably mounted on the implement to allow for easy refilling or replacing with a filled reservoir. In certain embodiments, the kit may include directions for use.

As can be appreciated, the various applications for the cleaning composition include, but are not limited to, domestic and industrial applications. Several applications include, but are not limited to, power wash solutions, deck cleaners, vehicle cleaners, house siding cleaners, roofing and construction cleaners, fire arm cleaners, etc. Depending on the particular application for the cleaning composition, the cleaning composition may be formulated to include additional ingredients to disinfect, sanitize, and/or sterilize the surface to be cleaned.

As discussed above, the cleaning composition may be formulated in concentrated form or ready-to-use form. However, the cleaning composition may be formulated in gaseous, liquid, paste, gel, or solid form. The cleaning composition may therefore be dispensed from a liquid container, an aerosol container, a container for holding crystals or a paste, and the like.

Thus, the cleaning solution may be used to remove asphalt-based tars, general organic tars, greases (both hydrocarbon based, and plant based), oils (processed or naturally occurring), dirt, grimes, and other organic and non-organic compounds. The cleaning solution therefore emulsifies, wets, and suspends the agents to be removed quickly and completely, thus allowing difficult substances to be removed from skin, hands, face, tools, and all non-porous surfaces quickly, effectively, and without the need to use water or additional materials in the process of cleaning.

Accordingly, in various embodiments, the cleaning composition may be formulated to clean fabrics (e.g., clothing, boots, carpet, curtains, rugs, etc.). In various embodiments, the cleaning composition may be formulated for use in personal hygiene products (e.g., hand cleaners, body lotions, shampoos, hair conditioners, etc.). Thus, the cleaning composition may be employed for removal of heavy duty contamination which adheres firmly to the skin, such as, for example, fats, oils and other lubricants, asphalt-based materials, paints, lacquers, tar, graphite, carbon black, colored pigments and similar substances, such as occur in the industrial and public sector, in manual work, in agriculture, and also in the home.

In another aspect, the cleaning solution may be formulated as a foaming cleanser. When so formulated, the cleaning solution further includes at least one non-flammable propellant to rapidly generate, by pressing a button on a container containing the solution, an abundant foam that is then spread out over a surface to be cleaned, such as a part of the body. Thus, the cleaning composition of the present disclosure can be packaged in aerosol devices in the presence of any non-flammable propellant normally used for preparing aerosol compositions. Exemplary propellants include, but are not limited to, nitrogen, air and carbon dioxide, and mixtures thereof.

The foaming cleanser can be prepared by any conventional method of combining foam forming materials and propellant, for example by (a) confining a propellant in a compartment of an aerosol canister at a pressure sufficient for foaming; (b) confining the balance of the ingredients, including the cleaning solution, in a second compartment of the aerosol canister; and (c) allowing the propellant to escape from the first compartment to the second compartment, thereby producing a foaming cleanser. Methods for producing foaming cleansers include, but are not limited to, those described in U.S. Pat. No. 8,338,348, U.S. Pat. No. 5,451,396, U.S. Pat. No. 5,955,414, and U.S. Pat. No. 3,950,417, the entire contents of each of which are incorporated herein by reference.

Thus, the cleaning solution may be applied by spraying the solution on the surface to be cleaned using any spray device, such as spray bottle, foamer, pressure sprayer, or any high pressure spraying machine.

Although the invention has been described with reference to the above example, it will be understood that modifications and variations are encompassed within the spirit and scope of the invention. Accordingly, the invention is limited only by the following claims.

What is claimed is:

1. A cleaning composition comprising:
(a) 0.05% to 3.0% (w/v) of a non-ionic surfactant;
(b) 0.03% to 0.05% (w/v) of an ionic surfactant;
(c) 0.05% to 1.5% (w/v) of a first solvent;
(d) 0.05% to 1.0% (w/v) of a second solvent;
(e) 2.0% to 4.0% (w/v) of an oil, wherein the oil is selected from the group consisting of coconut, palm, castor, rapeseed, and soybean oils;
(f) 0.05% to 1.0% (w/v) of a moisturizing agent; and
(g) 89.45% to 97.77% (w/v) of water.

2. The cleaning composition of claim 1, wherein the non-ionic surfactant is 1.5% (w/v).

3. The cleaning composition of claim 1, wherein the non-ionic surfactant is derived from soybean oil and has a pH value between 6.5 and 7.5.

4. The cleaning composition of claim 1, wherein the ionic surfactant is 0.05% (w/v).

5. The cleaning composition of claim 1, wherein the ionic surfactant is a sodium salt of alkyl naphthalene sulfonic acid and has a pH value between 7.5 and 10.5.

6. The cleaning composition of claim 1, wherein the first solvent is 0.05% (w/v).

7. The cleaning composition of claim 1, wherein the first solvent is a dibasic ester solvent.

8. The cleaning composition of claim 1, wherein the second solvent is 1.0% (w/v).

9. The cleaning composition of claim 8, wherein the second solvent is a propanediol solvent.

10. The cleaning composition of claim 1, wherein the oil is 2.2% (w/v).

11. The cleaning composition of claim 1, wherein the oil is soybean oil.

12. The cleaning composition of claim 1, wherein the water is deionized water.

13. The cleaning composition of claim 1, wherein the water is 96.0% of the composition.

14. The cleaning composition of claim 1, wherein the composition is formulated as a liquid or foam.

15. A cleaning composition comprising:
(a) 1.5% (w/v) of a non-ionic surfactant;
(b) 0.05% (w/v) of an ionic surfactant;
(c) 0.05% (w/v) of a dibasic ester solvent;
(d) 1.0% (w/v) of a propanediol solvent;
(e) 2.2% (w/v) of an oil;
(f) 0.05% of a moisturizing agent; and
(g) 95.15% (w/v) of water.

16. A cleaning wipe comprising a substrate and a cleaning composition, wherein the composition comprises:
(a) 0.05% to 3.0% (w/v) of a non-ionic surfactant;
(b) 0.03% to 0.05% (w/v) of an ionic surfactant;
(c) 0.05% to 1.5% (w/v) of a dibasic ester solvent;
(d) 0.05% to 1.0% (w/v) of a propanediol solvent;
(e) 2.0% to 4.0% (w/v) of an oil;
(f) 0.05% to 1.0% of a moisturizing agent; and
(g) 89.45% to 97.77% (w/v) of water.

17. The cleaning wipe of claim 16, wherein the substrate comprises at least one material selected from the group consisting of melt-blown, coform, air-laid, spunbond, wet-laid, bonded-carded web materials, hydroentagled and spulaced materials.

18. The cleaning wipe of claim 17, wherein the substrate is a melt-blown, dual-textured, non-woven wipe.

19. A non-toxic cleaning kit comprising:
(a) at least one cleaning substrate pre-loaded with a non-toxic cleaning solution comprising:
(i) 0.05% to 3.0% (w/v) of a non-ionic surfactant;
(ii) 0.03% to 0.05% (w/v) of an ionic surfactant;
(iii) 0.05% to 1.5% (w/v) of a dibasic ester solvent;
(iv) 0.05% to 1.0% (w/v) of a propanediol solvent;
(v) 2.0% to 4.0% (w/v) of an oil;
(vi) 0.05% to 1.0% of a moisturizing agent; and
(vii) 89.45% to 97.77% (w/v) of water; and
(b) a packaging system dispensibly housing the at least one cleaning substrate.

20. The non-toxic cleaning kit of claim 19, wherein the at least one cleaning substrate is a melt-blown, dual-textured, non-woven wipe.

21. The non-toxic cleaning kit of claim 19, further comprising an implement configured for detachable mounting of the substrate.

22. The non-toxic cleaning kit of claim 19, further comprising directions for use.

23. A method for cleaning a hard surface comprising contacting the surface with the cleaning composition of claim 1.

* * * * *